US006863387B2

(12) United States Patent
Thielman et al.

(10) Patent No.: US 6,863,387 B2
(45) **Date of Patent: *Mar. 8, 2005**

(54) INK SUPPLY WITH AIR DIFFUSION BARRIER FOR UNSATURATED INK

(75) Inventors: Jeffrey L Thielman, Corvallis, OR (US); Rhonda L. Wilson, Monmouth, OR (US); Norman E. Pawlowski, Jr., Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 10 days.

This patent is subject to a terminal disclaimer.

(21) Appl. No.: 09/758,744

(22) Filed: Jan. 11, 2001

(65) Prior Publication Data

US 2003/0025771 A1 Feb. 6, 2003

Related U.S. Application Data

(63) Continuation-in-part of application No. 09/037,550, filed on Mar. 9, 1998, now Pat. No. 6,203,146.

(51) Int. Cl.[7] ..... B41J 2/175
(52) U.S. Cl. ..... 347/86
(58) Field of Search ..... 347/85, 86, 87, 347/92; 222/1

(56) References Cited

U.S. PATENT DOCUMENTS

| | | | | |
|---|---|---|---|---|
| 3,371,350 A | 2/1968 | Sanderson et al. | ..... | 346/140.1 |
| 4,509,062 A | 4/1985 | Low et al. | ..... | 347/87 |
| 4,558,326 A | 12/1985 | Kimura | ..... | 347/30 |
| 4,920,362 A | 4/1990 | Cowger | ..... | 347/87 |
| 4,992,802 A | 2/1991 | Dion et al. | ..... | 347/87 |
| 5,367,328 A | 11/1994 | Erickson | ..... | 347/7 |
| 5,369,429 A | 11/1994 | Erickson | ..... | 347/7 |

(List continued on next page.)

FOREIGN PATENT DOCUMENTS

| | | | |
|---|---|---|---|
| EP | 0287098 B1 | 10/1988 | ..... B41J/3/04 |
| EP | 0562717 B2 | 9/1993 | ..... B41J/2/175 |
| EP | 0745482 A2 | 5/1995 | ..... B41J/2/175 |
| EP | 0770490 A2 | 10/1995 | ..... B41J/2/19 |
| EP | 0714778 B1 | 6/1996 | ..... B41J/2/17 |
| JP | 62-121062 | 6/1987 | |
| JP | 62-161544 | 7/1987 | |
| JP | 07076094 | 6/1993 | ..... B41J/2/175 |
| JP | 7-266575 | 10/1995 | |
| WO | WO 97/16315 | 5/1997 | ..... B41J/2/175 |
| WO | WO 99/08876 | 2/1999 | |

OTHER PUBLICATIONS

U.S. patent application Ser. No. 09/758,746, Thielman et al., filed Sep. 2001.*
Patent Abstracts of Japan; Publication No. JP 07266575A, Oct. 17, 1995, Seiko Epson Corporation.
Patent Abstracts of Japan; Publication No. JP 62121062A, Jun. 2, 1987, Seiko Epson Corp.
Translation of Japanese Patent Office Action re Japanese Application No. 2002–1356, dated Jul. 17, 2003, 2 pages, see page 2, first 3 paragraphs.

*Primary Examiner*—Anh T. N. Vo

(57) ABSTRACT

An ink supply for an inkjet printing system, the ink supply having one or more areas of relatively high air diffusion through one or more structures comprising the ink supply. One or more air diffusion barrier structures shield the one or more areas of relatively high air diffusion from air diffusion, and a quantity of liquid unsaturated ink is disposed in the ink supply.

21 Claims, 10 Drawing Sheets

U.S. PATENT DOCUMENTS

| | | | | | |
|---|---|---|---|---|---|
| 5,409,134 | A | * | 4/1995 | Cowger et al. | 222/1 |
| 5,488,400 | A | | 1/1996 | Crystal et al. | 347/85 |
| 5,505,339 | A | | 4/1996 | Cowger et al. | 222/105 |
| 5,552,815 | A | | 9/1996 | Shimoda | 347/85 |
| 5,719,609 | A | | 2/1998 | Hauck et al. | 347/85 |
| 5,724,082 | A | | 3/1998 | Moynihan | 347/88 |
| 5,742,311 | A | | 4/1998 | Koitabashi et al. | 347/86 |
| 5,872,584 | A | | 2/1999 | Hauck et al. | 347/86 |
| 5,900,890 | A | | 5/1999 | Mitchell | 347/28 |
| 5,971,529 | A | * | 10/1999 | Pawlowski, Jr. et al. | 347/86 |
| 5,975,689 | A | | 11/1999 | Pawlowski, Jr. et al. | 347/86 |
| 5,988,801 | A | | 11/1999 | Coiner | 347/85 |
| 6,017,118 | A | | 1/2000 | Gasvoda et al. | 347/86 |
| 6,068,370 | A | | 5/2000 | Miller et al. | 347/85 |
| 6,089,702 | A | | 7/2000 | Hilton | 347/92 |
| 6,203,146 | B1 | | 3/2001 | Pawlowksi, Jr. et al. | 347/85 |

* cited by examiner

FIG. 6
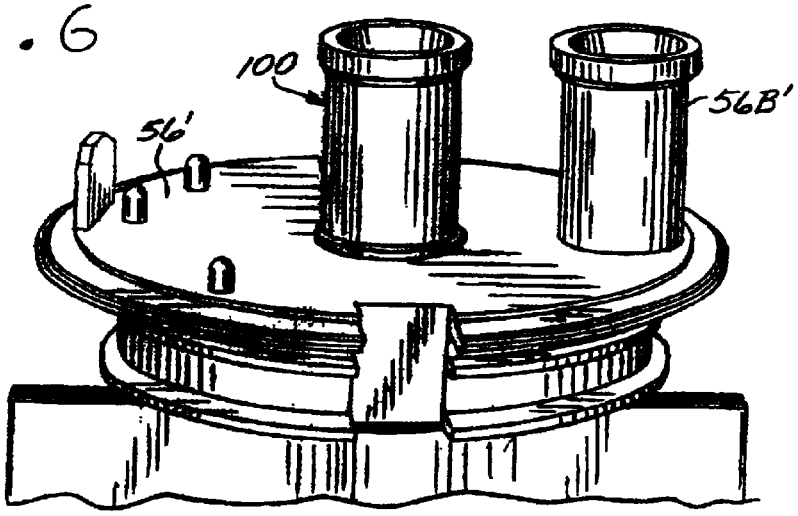
FIG. 7
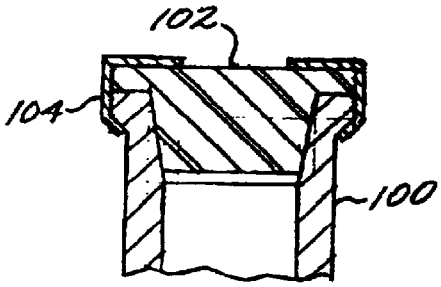
FIG. 8
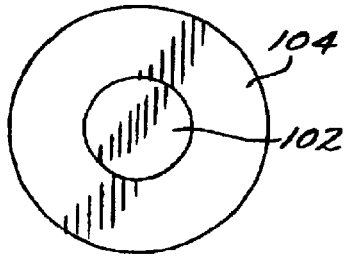
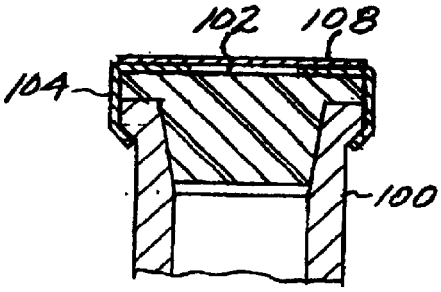
FIG. 9
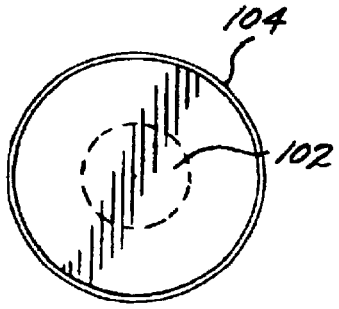
FIG. 10

8/10

INK SUPPLY WITH AIR DIFFUSION BARRIER FOR UNSATURATED INK

CROSS-REFERENCE TO RELATED APPLICATION

This application is a continuation-in-part of application Ser. No. 09/037,550, filed Mar. 9, 1998 now U.S. Pat. No. 6,203,146, PRINTING SYSTEM WITH AIR ACCUMULATION CONTROL MEANS ENABLING A SEMIPERMANENT PRINTHEAD WITHOUT AIR PURGE, the entire contents of which are incorporated herein by this reference.

This application is also related to application Ser. No. 09/758,746 filed Jan. 11, 2001, PRINTHEAD AIR MANAGEMENT USING UNSATURATED INK, the entire contents of which are incorporated herein by this reference.

TECHNICAL FIELD OF THE INVENTION

This invention relates to ink supplies for inkjet printing systems, and more particularly to an ink supply with air barrier structures for holding unsaturated ink.

BACKGROUND OF THE INVENTION

Inkjet printing systems frequently make use of an inkjet printhead mounted to a carriage which is moved back and forth across a print media, such as paper. As the printhead is moved across the print media, control electronics activate an ejector portion of the printhead to eject, or jet, ink droplets from ejector nozzles and onto the print media to form images and characters. An ink supply provides ink replenishment for the printhead ejector portion.

Some printing systems make use of an ink supply that is replaceable separately from the printhead. When the ink supply is exhausted the ink supply is removed and replaced with a new ink supply. The printhead is then replaced at or near the end of printhead life and not when the ink supply is exhausted. When a replaceable printhead is capable of utilizing a plurality of ink supplies, this will be referred to as a "semipermanent" printhead. This is in contrast to a disposable printhead, that is replaced with each container of ink.

A significant issue with semipermanent printheads is premature failure due to loss of proper pressure regulation. To operate properly, many printheads have an operating pressure range that must be maintained in a narrow range of slightly negative gauge pressure, typically between −1 and −6 inches of water. Gauge pressure refers to a measured pressure relative to atmospheric pressure. Pressures referred to herein will all be gauge pressures. If the pressure becomes positive, printing and printing system storage will be adversely affected. During a printing operation, positive pressure can cause drooling and halt ejection of droplets. During storage, positive pressure can cause the printhead to drool. Ink that drools during storage can accumulate and coagulate on printheads and printer parts. This coagulated ink can permanently impair droplet ejection of the printhead and result in a need for costly printer repair. To avoid positive pressure, the printhead makes use of an internal mechanism to maintain negative pressure.

Air present in a printhead can interfere with the maintenance of negative pressure. When a printhead is initially filled with ink, air bubbles are often present. In addition, air accumulates during printhead life from a number of sources, including diffusion from outside atmosphere into the printhead and dissolved air coming out of the ink referred to as outgassing. During environmental changes, such as temperature increases or pressure drops, the air inside the printhead will expand in proportion to the total amount of air contained. This expansion is in opposition to the internal mechanism that maintains negative pressure. The internal mechanism within the printhead can compensate for these environmental changes over a limited range of environmental excursions. Outside of this range, the pressure in the printhead will become positive.

One solution to the air accumulation problem has been the use of disposable printheads. The amount of ink associated with a disposable printhead can be adjusted to keep air accumulation below a critical threshold. When the amount of ink is small, this increases the cost of printing by requiring frequent printhead replacement. Alternatively, the ink container can be made large to reduce frequency of printhead replacement. However, large ink containers become problematic when the printing application is a compact desktop printer. An example of a system utilizing a disposable printhead, wherein a large ink supply is replaced each time the printhead is replaced, is described in U.S. Pat. No. 5,369,429.

Another solution to the air accumulation problem has been the use of air purge mechanisms to make semipermanent printheads viable. An example of an air purge approach is described in U.S. Pat. No. 4,558,326. Issues with purging systems include the added printer cost for the purge mechanism, the reliability problems associated with accommodating the ink that tends to be purged out with air, and the stranding of air in the ink ejectors of the printhead, and increase in maintenance requirements.

Another solution to air management in inkjet printheads has been in the form of air warehousing. Air generated during the life of the pen is stored in the printhead. This requires the printhead to be able to compensate for expansion of the stored air due to thermal and pressure variations, which necessitates additional size and complexity. This additional size constrains the printer by placing more mass on the carriage and requiring a larger carriage for the printheads. As more printheads are added to the carriage, this issue becomes even more important.

It is known to use unsaturated ink in filling ink supplies. Insofar as is known, however, unsaturated ink has not heretofore been employed in addressing the problem of air accumulation in ink jet printheads.

SUMMARY OF THE INVENTION

Problems of air management in an inkjet printhead are addressed by preventing or minimizing the generation of air bubbles during the printing process, and providing techniques for reabsorption of air that does get introduced into the printing system.

An ink supply is described for an inkjet printing system, the ink supply having one or more areas of relatively high air diffusion through one or more structures comprising the ink supply. In accordance with an aspect of the invention, one or more air diffusion barrier structures shield the one or more areas of relatively high air diffusion from air diffusion, and a quantity of liquid unsaturated ink is disposed in the ink supply.

In accordance with another aspect of the invention, the ink supply has a shelf life of at least six months, and preferably at least eighteen months, while maintaining the ink within the supply at an air saturation level low enough to provide the capability of resolubizing air.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is an isometric view of the chassis of FIG. 3 with the insert installed, prior to attachment of the bag to the chassis.

FIG. 7 is a cross-sectional view taken through the tip of the insert after the septum and metal crimp can have been installed.

FIG. 8 is a top view of the structure shown in FIG. 7.

FIG. 9 is a view similar to FIG. 7, showing a metal layer affixed to the septum to provide an air diffusion barrier.

FIG. 10 is a top view of the structure of FIG. 9.

DETAILED DESCRIPTION OF THE PREFERRED EMBODIMENTS

In accordance with an aspect of the invention, an ink supply is described, wherein measures are taken to prevent the ingress of air into the ink supply from the external environment. Moreover, the ink container holds unsaturated ink, which provides the capability of absorbing some quantity of air within the printing system and therefore preventing or reducing the harmful buildup of air bubbles within the system.

Figure 1:
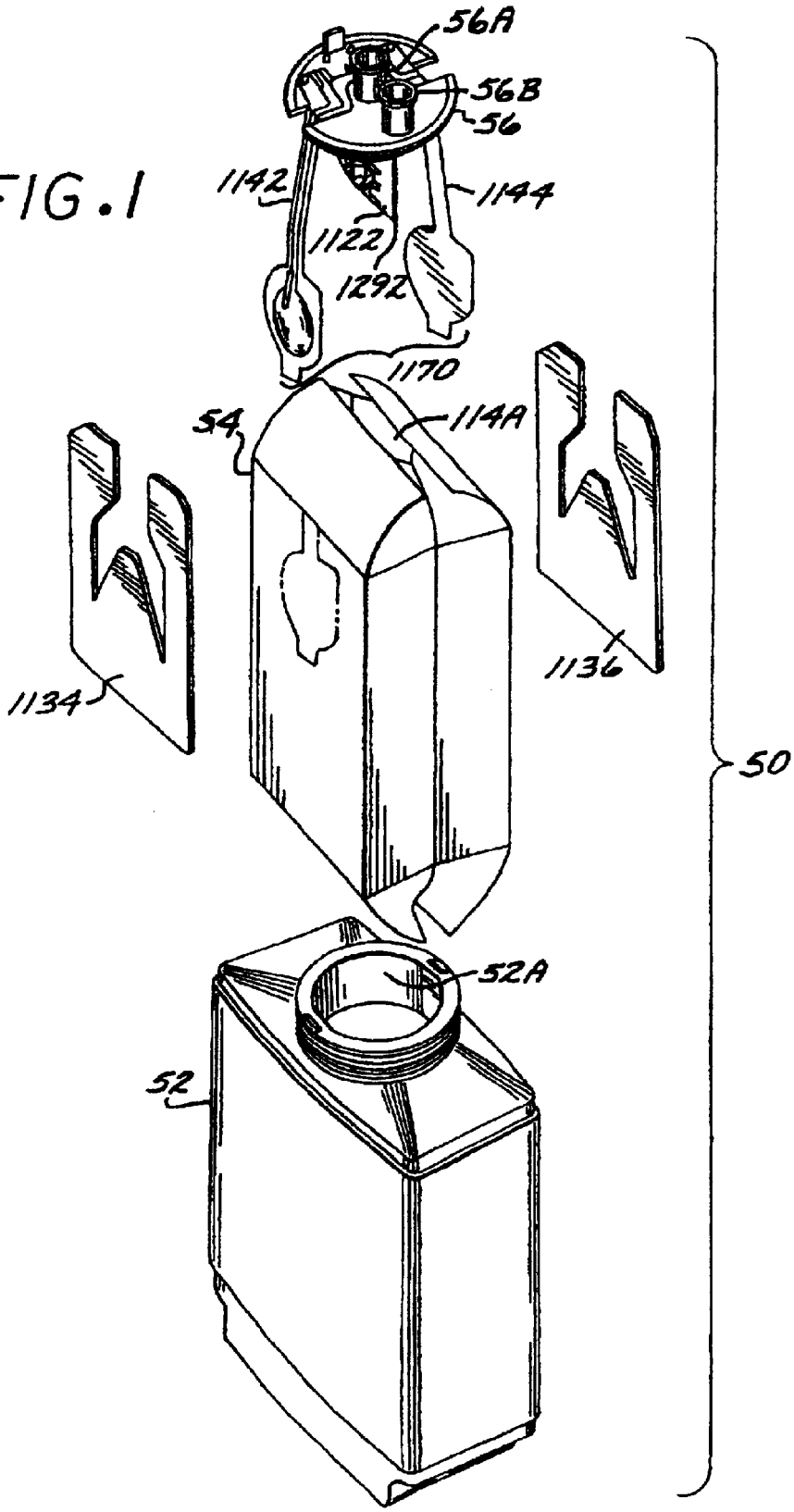
FIG. 1 is an exploded isometric view of a pressurizable ink supply for an inkjet printing system.

This aspect of the invention is described with respect to the exemplary ink container described in U.S. Pat. No. 6,017,118, and generally illustrated in FIG. 1. For this example, the supply 50 is pressurized, and includes a pressure vessel 52 within which a collapsible bag 54 containing the ink is disposed. The bag 54 is attached to a chassis 56 which is mounted in the neck opening 52A of the bottle-like pressure vessel. The chassis 56 has separate ink and air towers 56A, 56B formed therein, with the ink tower containing a fluid path leading to the interior of the bag, and the air tower providing an air path to the pressurized region surrounding the bag within the pressure vessel. In an exemplary embodiment, the chassis member is a unitary element, fabricated of polyethylene by injection molding.

The collapsible bag is typically fabricated of multiple layers including a metalized or other layer providing very low air diffusion. In an exemplary embodiment, the collapsible bag can have the following construction of layers: LLDPE/LLDPE/Nylon//PET/Silver or Aluminum oxide or silicon oxide//Nylon, where "/" represents a coextruded or deposition bond of the layers, and "//" represents an adhesive bond. Other bag structures can also be used, e.g. linear low-density polyethylene (LLDPE)/LLDPE/LLDPE// polyamide (e.g. Nylon)//Al Foil or ethylene vinyl alcohol (EVOH) or Polyvinylidene Chloride copolymer (PVDC)// polyamide.

Figure 2:
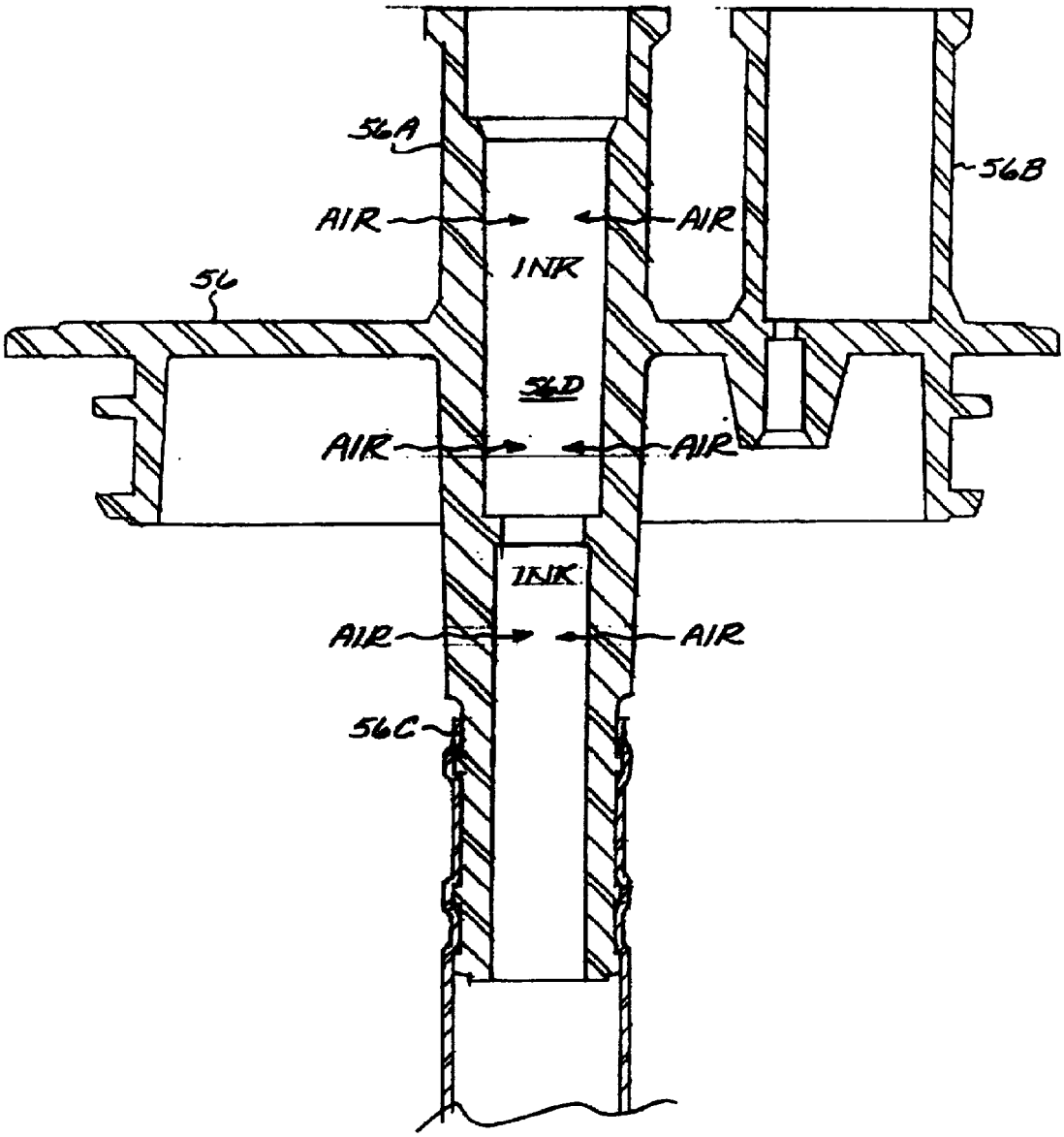
FIG. 2 is a simplified cross-sectional diagram of the chassis member of the ink supply of FIG. 1.

This construction of the collapsible bag substantially prevents air diffusion through the bag and into the ink. It has been found, however, that the chassis member fabricated of a polyethylene such as LLDPE can provide an air diffusion path into ink stored in the ink container, i.e. through the chassis member into the ink. This air path is illustrated in FIG. 2, a simplified cross-sectional view of the chassis 56. The bag is attached to the chassis along a keel section 56C, and the air diffusion paths are generally above this attachment, through the LLDPE material defining the ink flow path 56D through the channel in the air flow tower.

Figure 3:
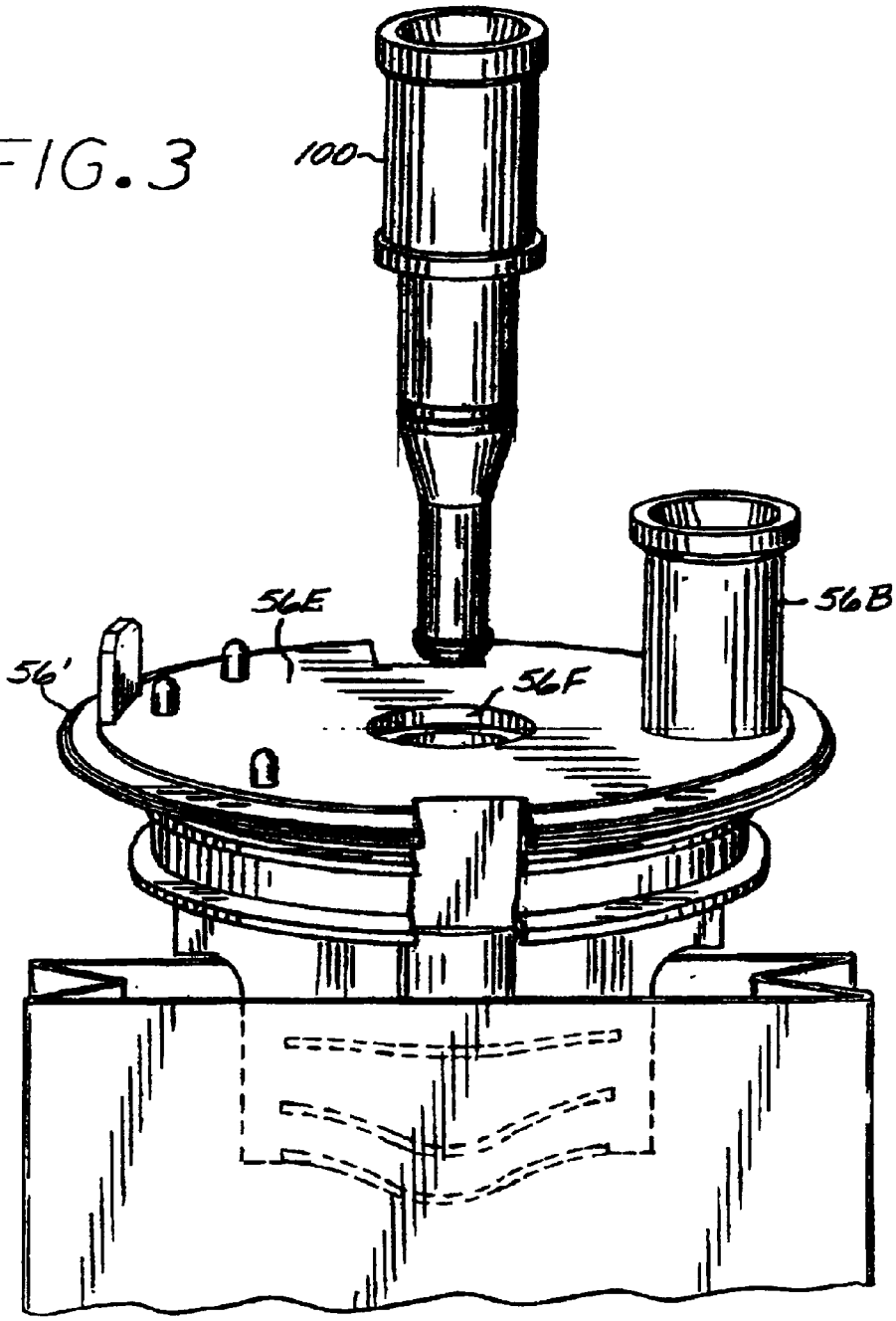
FIG. 3 is an exploded isometric view of a modified chassis with a metal insert in accordance with an aspect of the invention.

In accordance with an aspect of the invention, substantial improvements in the supply shelf life and quantity of delivered air to the printhead is achieved by improving the air barrier properties of the chassis. In an exemplary embodiment shown in FIG. 3, the air diffusion path through the chassis air tower material is closed by use of a metal insert 100 which is extended through the ink flow path of the chassis. The metal insert is fabricated of a material such as stainless steel, which is impermeable to air. In this embodiment, the chassis 56' is modified from the chassis 56 of FIGS. 1 and 2, in that the ink tower 56A protruding from the external surface 56E is eliminated, so that the chassis 56' has an opening 56F formed through the LLDPE material leading through the keel section of the chassis as in the embodiment of FIG. 1. The metal insert 100 is sized for a press fit into the opening 56F. Ultrasonic insertion, spin welding or heat could also be employed to improve the chassis-to-insert sealing and assembly force.

Figure 4:
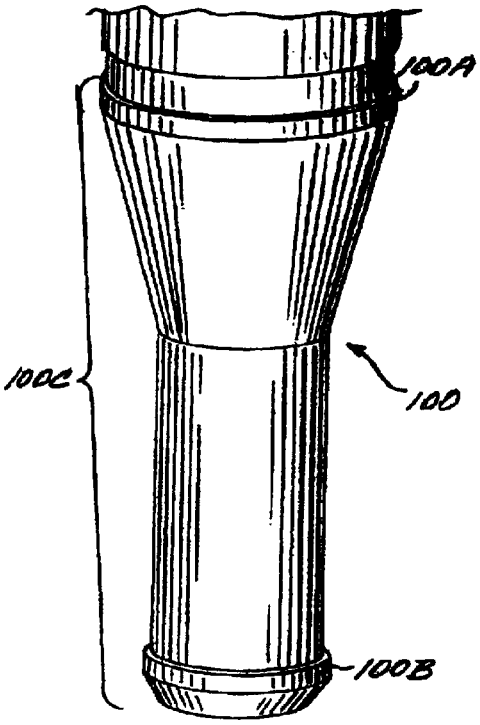
FIG. 4 illustrates the lower portion of the insert which is inserted into the chassis opening.

FIG. 4 illustrates the lower portion of the insert 100 which is inserted into the chassis opening. Circumferential areas 100A, 100B of the insert are enlarged relative to the inner diameter of the tapered chassis opening. Thus, the outer cross-sectional dimensions of the insert portion 100C are generally sized for fitting into the chassis opening, and areas 100A, 100B are slightly oversized relative to the chassis opening dimensions at the extremities of the insert portion 100C to provide an interference fit.

Figure 5:
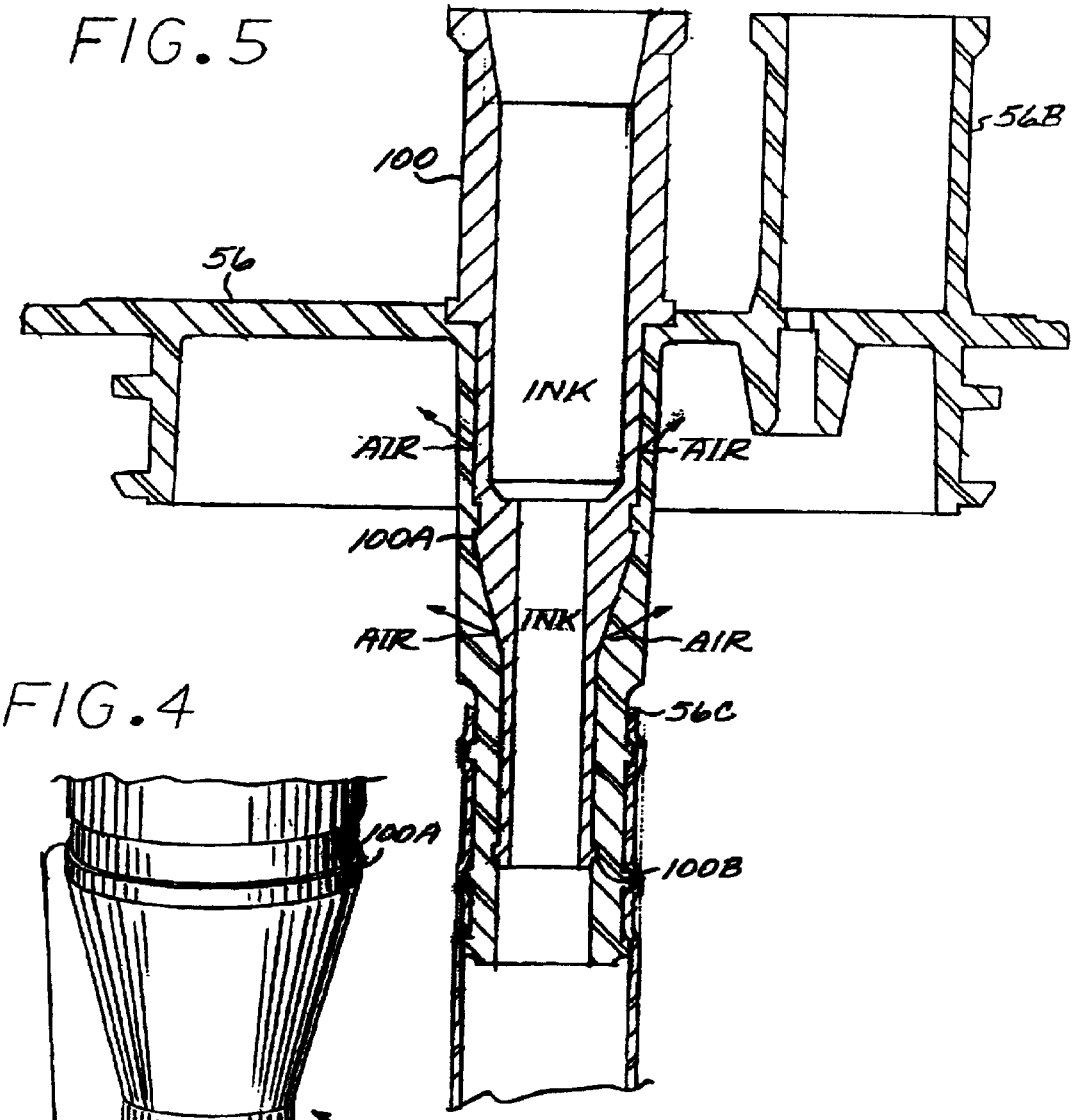
FIG. 5 is a simplified cross-sectional diagram showing the chassis of FIG. 3 with the insert in place.

FIG. 5 is a simplified cross-sectional diagram showing the chassis 56 with the insert 100 in place. Lower interference fit region 100B of the insert engages tightly with the adjacent areas of the chassis to define a primary seal area preventing the passage of ink, and area 100A provides a secondary seal area. The primary air diffusion paths are blocked by the insert.

FIG. 6 is an isometric view of the chassis 56' with the insert 100 installed, prior to attachment of the bag to the chassis.

Other chassis embodiments can alternatively be employed to provide improved air barrier performance. For example, the chassis insert 100 could alternatively be fabricated of stainless steel, ceramic or a higher barrier polymer, such as, by way of example only, polyamide, polyethylene teraphthalate (PET), acrylonitrile-butadiene-styrene (ABS), polyphenylene sulfide (PPS) or liquid crystal polymer (LCP). Another alternate embodiment is to fabricate the chassis 56 of a high air barrier material such as a polymer including polyamide, PET, ABS, PPS or LCP. To provide the ability to heat stake the collapsible bag to the chassis keel, an LLDPE piece can be either overmolded or pressed onto the chassis bottom portion to serve as a heat-stakable region to which the collapsible bag is attached.

Another source of air transmission into the ink supply 50 is through the septum and around the chassis/septum seal on the ink tower. FIG. 7 is a cross-sectional view taken through the tip of the insert 100 after the septum 102 and metal crimp can 104 have been installed. In the past, the septum has been fabricated of polyisoprene, which is a poor barrier to air diffusion, i.e. polyisoprene has a high air diffusion rate characteristic. The septum 102 is positioned at the top of the ink tower, provided in this case by the metal insert 100, and is held in place by the crimp can 104, fabricated of aluminum. FIG. 8 is a top view of the structure shown in FIG. 7, and shows that the crimp can 104 has a circular opening formed therein, exposing an area of the septum to the ambient atmosphere. When the ink supply is installed at the ink station of a printer, the ink station has a corresponding fitting including a hollow needle to penetrate the septum and allow ink to flow through the needle through a fluid conduit to a printhead. Prior to such installation, the exposed area of the septum provides an air diffusion path to diffuse into the ink supply through the ink flow path within the insert 100.

In accordance with a further aspect of the invention, the air diffusion path through the septum 102 is blocked by an air diffusion barrier structure, such as an adhesive-backed metal layer or tape 108, as illustrated in FIGS. 9 and 10. In an exemplary embodiment, the tape 108 comprises a thin layer of metal such as aluminum or copper, with a layer of adhesive applied to one side thereof. In an exemplary embodiment, the metal layer has a thickness of 0.003 inch, but thinner or thicker layers could also be used. In this embodiment, the tape 108 is placed over the septum 102 after the supply has been filled with ink through the septum. The tape is left in place during storage and use. When the ink supply is installed in the printer, the needle in the printer punctures the tape and penetrates the septum to allow ink to flow. Thus, the tape is not handled by the printer user.

In accordance with a further aspect of the invention, the septum 102 can be fabricated of a material which provides an excellent barrier to air diffusion, such as ethylene-propylene-diene monomer (EPDM), Butyl, an EPDM/polypropylene (PP) blend such as Santoprene, a Butyl/PP blend such as Trefsin, or other elastomers to improve the air barrier. Santoprene and Trefsin are products marketed by Advanced Elastomer Systems. In this case, for some applications, the tape 108 may be omitted, the septum providing the high air diffusion barrier. Of course, the metal tape 108 can included to provide additional margin against air diffusion.

Figure 12:
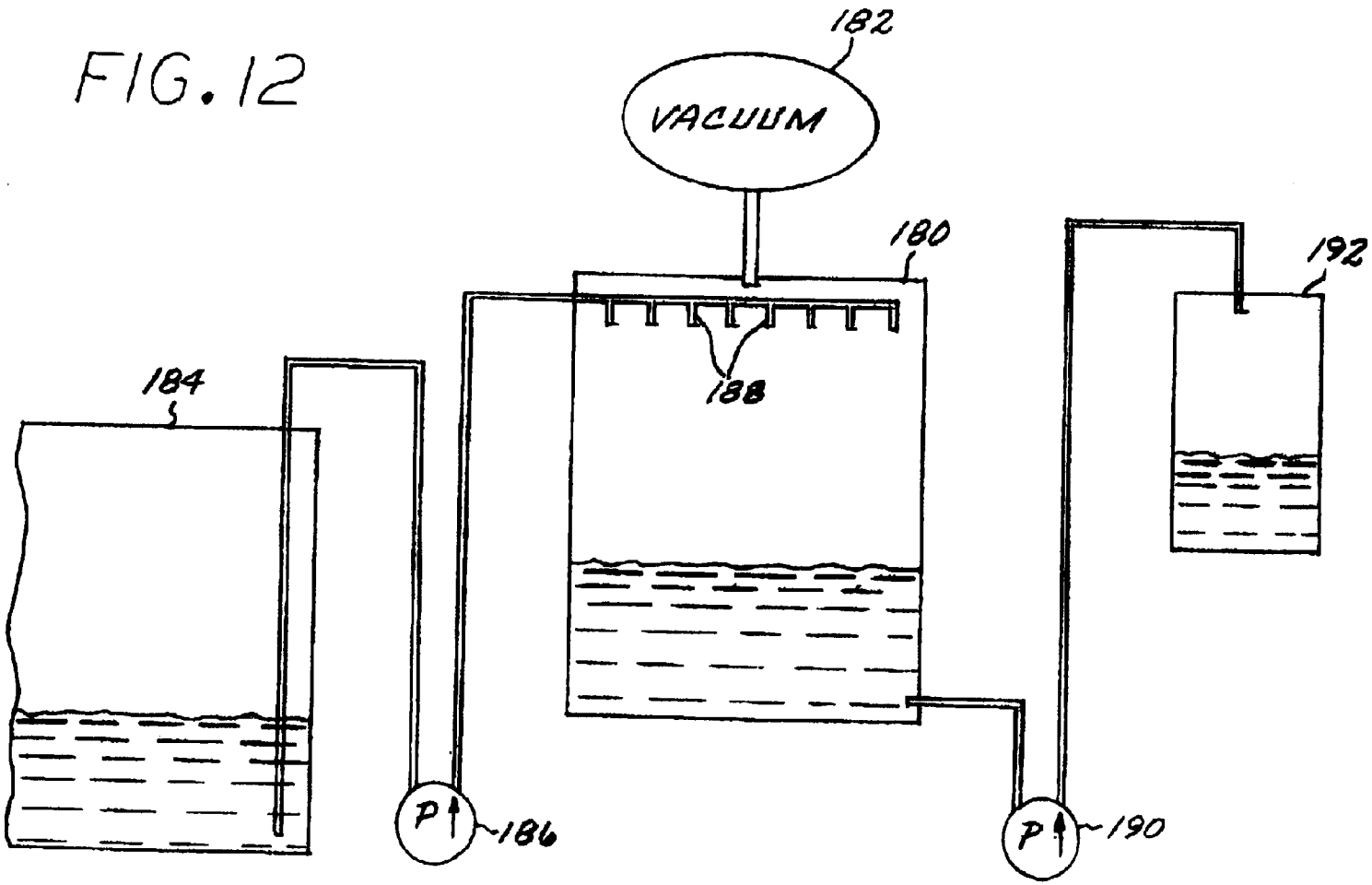
FIG. 12 is a diagrammatic view illustrating an exemplary process for degassing ink.

The above-described steps are taken to reduce the air diffusion paths into the ink supply, and thereby reduce the risk of air diffusion into the ink supply. In accordance with a further aspect of the invention, the ink used to fill the container is unsaturated. The saturation level of a liquid is dependent on its temperature, the ambient pressure and the liquid (ink) composition. In a preferred embodiment, the unsaturated ink is provided by a "degassing" technique in which the dissolved air has been removed from the ink. Techniques for degassing liquid inks are known in the art. FIG. 12 is a simplified diagrammatic illustration of a degassing process which can be employed to degas ink. A degas tank 180 is provided, and is connected to a source 182 of vacuum to pull the tank pressure to a fairly high vacuum. Ink to-be-processed is pumped from a supply container 184 by a pump 186 into the degas tank, through small needles 188 which spray the ink into the degas tank in a fine mist. When this mist is exposed to the vacuum within the degas tank, most of the air that is dissolved in the ink comes out from the ink, producing unsaturated or degassed ink. The unsaturated ink is then pumped by pump 190 from the degas tank into a degassed ink container 192, from which the ink is dispensed into the ink supplies 50. Other techniques can be employed to produce unsaturated ink, such as heating the ink, reducing the capacity of the ink to hold dissolved air and therefore causing the ink to release dissolved air. When the heated ink is cooled, it is unsaturated.

In an exemplary embodiment, the unsaturated ink dispensed into the ink supply 50 will have an air saturation level of no greater than 20%. As used herein, air saturation level is the percentage of dissolved (solubized) air in the liquid, compared to the maximum amount of air which can be dissolved in the liquid. Further, the ink supply 50 in accordance with a further aspect of the invention is protected against air diffusion into the ink such that the unsaturated ink held within the supply will have a useful shelf life prior to installation in a printing system of at least six months, and preferably at least eighteen months. Experimental work with an exemplary ink indicates that unsaturated ink with an air saturation level of 70% or less is necessary to resolubize significant amounts of air, for a particular ink and ink jet pen. This air saturation level needed to resolubize significant amounts of air will vary, depending on the ink characteristics and the printhead characteristics. This needed saturation level depends on printhead characteristics for several reasons. One is that the thermal characteristics of different printheads vary. If one printhead gets hotter than another type of printhead during operation, the efficiency of the hotter printhead will be less than the cooler printhead, and a lower saturation level will be needed. Also the volume of the ink within the printhead affects the saturation level, since the larger the volume, the longer the dwell time of ink near the air, and the more air can be absorbed. Thus, in accordance with another aspect of the invention, the ink delivered to the printhead has an air saturation level low enough to resolubize free air in the print cartridge on which the printhead is mounted. The ink within the ink supply should have not exceed this saturation level during the shelf life of the ink supply. In one exemplary embodiment, this air saturation level does not exceed 70%, and is preferably less, e.g. less than 50%.

With unsaturated ink filling the ink supply, and with the measures taken to substantially reduce the air diffusion rate into the ink supply, the ink supplied from the ink supply 50 after it is installed in a printer will be free of air bubbles and in an unsaturated stated, ideally free of dissolved air. By ensuring that the ink in the ink supply 50 remains degassed (unsaturated) over the life of the ink supply, air generation in the printer can be controlled. This is due to the capability of unsaturated ink to remove air in the printing system, i.e. by "regassing" or absorbing air bubbles as dissolved air. Thus, the invention includes preventing the generation of air bubbles during the printing process by providing barriers to air diffusion in the ink supply, and through the use of unsaturated ink providing a way to reabsorb any air that does get introduced into the printing system. An advantage of this technique is that it will contribute to the miniaturization of inkjet printhead architectures by reducing the volume needed to warehouse air and compensate for its expansion due to ambient thermal and pressure variations.

Figure 11:
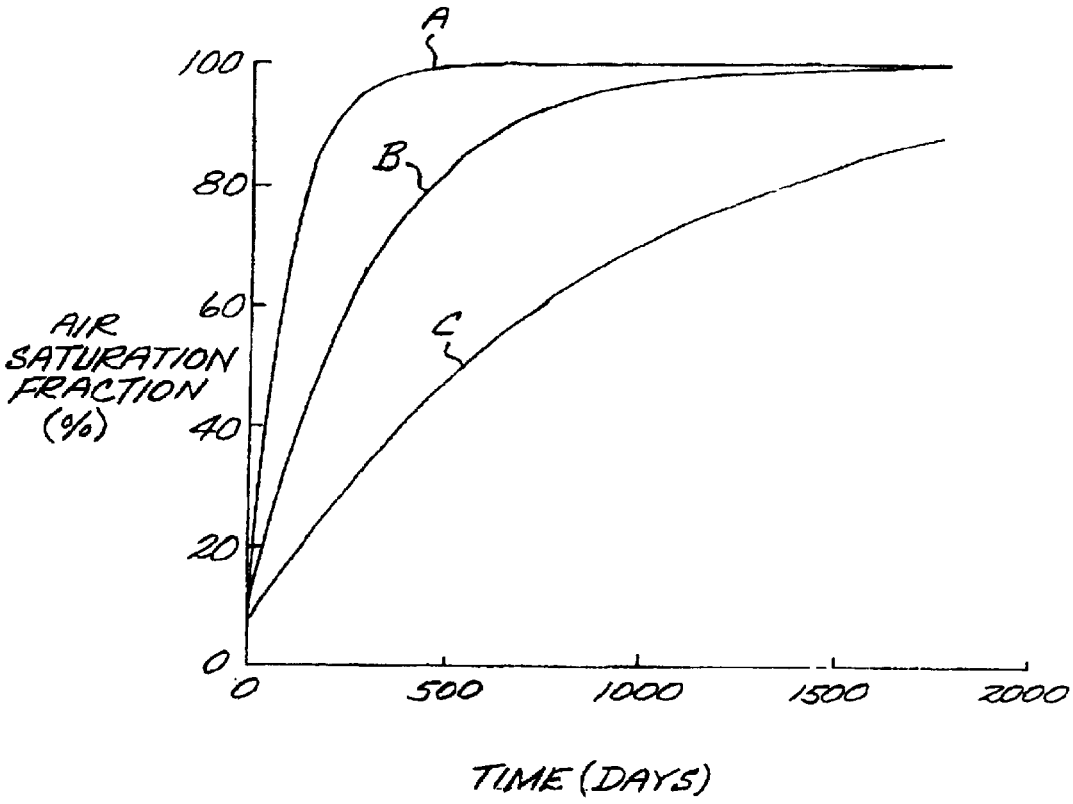
FIG. 11 is a graph depicting predicting ink resaturation rates for different ink supply features.

FIG. 11 is a graph indicated predicted ink resaturation rates for an ink supply for three different cases. The rate of resaturation is dependent on the volume of ink, and the ink supply whose resaturation rate is predicted in FIG. 11 is a large supply with at least 800 cc of a particular type of ink. Curve A indicates the predicted ink resaturation for a supply with a low density polyethylene chassis, a poor air diffusion barrier, and a reservoir bag including a polymer film of PVDC. Curve B indicates the predicted resaturation rate of a similar ink supply but with the reservoir bag including a metalized film as an air diffusion barrier. Curve C indicates a predicted resaturation rate for a similar ink supply to that of curve B, but with a metal fluid interconnect insert in the chassis. It can be seen that each of these air diffusion barrier measures affects the resaturation rates of the ink supply.

Ink is resaturated by air diffusion through the various materials used in the printing system and through absorption of free air from within the printhead. The air diffusion components is modeled by Fick's Law.

$$\frac{\partial V}{\partial t} = \frac{P \cdot A}{\text{thickness}} \cdot \Delta P$$

where V is the volume, t is time, A is diffusion area, thickness is the thickness of the diffusion area, Δp is the pressure difference (atmospheric air versus unsaturated ink), and P is the permeability of the material, which is a material specific property. A low P indicates a low diffusion rate, and a high P a high diffusion rate.

The air absorption capacity of a volume of ink can be determined using its air saturation level. For example, assume that the unsaturated ink has an air saturation level of 65%, so that it has a capacity to absorb an additional 35% before reaching the saturation level. If the ink holds 0.002 cc-air/cc-ink, then it could absorb 0.35*(0.002)=0.0007 cc-air/cc-ink.

As noted above, for one exemplary embodiment, the ink delivered to the printhead has an air saturation level of 70%, and preferably less. Once the ink supply 50 is installed in the printing system, the fluid interconnect between the ink supply 50 and the ink jet printhead or cartridge can allow air to enter the ink, and so the fluid interconnect should also provide a high barrier to air diffusion. Preferably, the tubes used for the fluid paths have a sufficiently low air diffusion property as to maintain ink held in the tubing in an unsaturated state for at least one day, and preferably for at least several days. This addresses the situation in which the printing system is not used overnight or for a weekend period, thus protecting the quantity of ink in the tubing.

Tubing useful for the fluid path and presenting a high barrier to air diffusion is described in U.S. Pat. No. 6,068,370. As described therein, the tubing can be fabricated of Polyvinylidene Chloride copolymer (PVDC), polychlorotrifluoroethylene (PCTFE) copolymer and ECTFE (ethyenechlorotrifluoroethylene). Other tubing suitable for the purpose is described in U.S. Pat. No. 5,988,801, HIGH PERFORMANCE TUBING FOR INKJET PRINTING SYSTEMS WITH OFF-BOARD INK SUPPLY.

Figure 13:
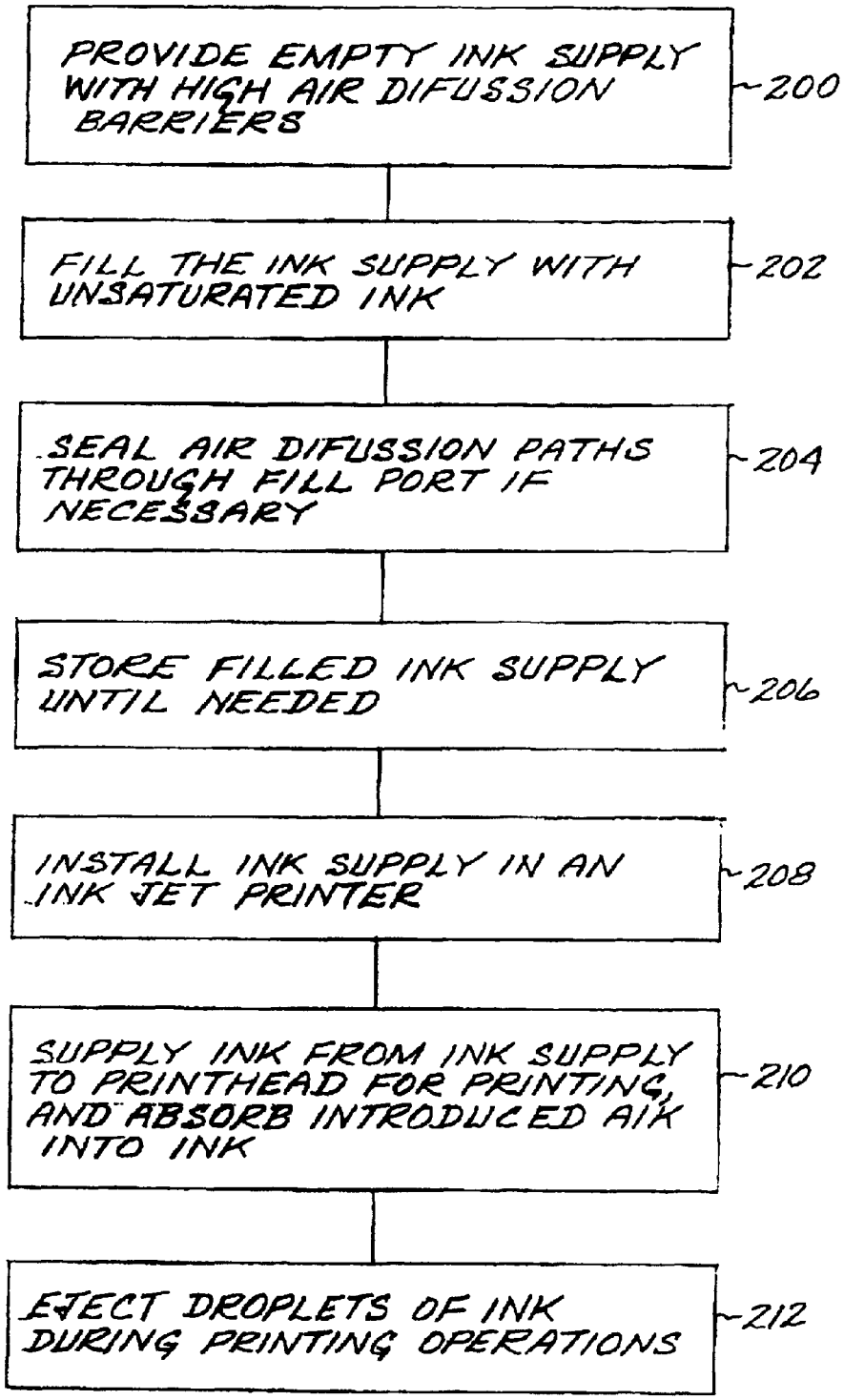
FIG. 13 is a flow diagram illustrating an exemplary method for managing air in an inkjet printing system with an ink supply in accordance with aspects of the invention.

FIG. 13 is a flow diagram illustrating an exemplary method for managing air in an inkjet printing system with an ink supply in accordance with aspects of the invention. At 200, an empty ink supply is provided with high air diffusion barriers. In an exemplary embodiment, the ink supply includes barriers such as the metallized bag for holding a supply of ink, and a metal insert lining the ink flow path from the bag outlet to the fluid interconnect for the ink supply.

At step 202, the ink supply is filled with unsaturated ink. This can be done, for the exemplary embodiment of FIGS. 3–8, by inserting a fill needle through the septum, with the needle coupled to a fill supply of unsaturated ink by a fluid conduit, and then releasing unsaturated ink through the fluid conduit and needle into the bag of the ink supply. Then, after filling the supply, the fill port into the bag is sealed by an air barrier such as metal tape positioned over the septum. Thereafter, the filled ink supply can be stored at 206 until needed or shipped and sold to a user. The ink supply is then installed in an ink jet printing system having an inkjet printhead at 208, and ink is supplied to the printhead from the ink supply for printing. The unsaturated ink supplied from the ink supply has the capability of absorbing air bubbles introduced into the system until the ink reaches a saturated condition.

Figure 14:
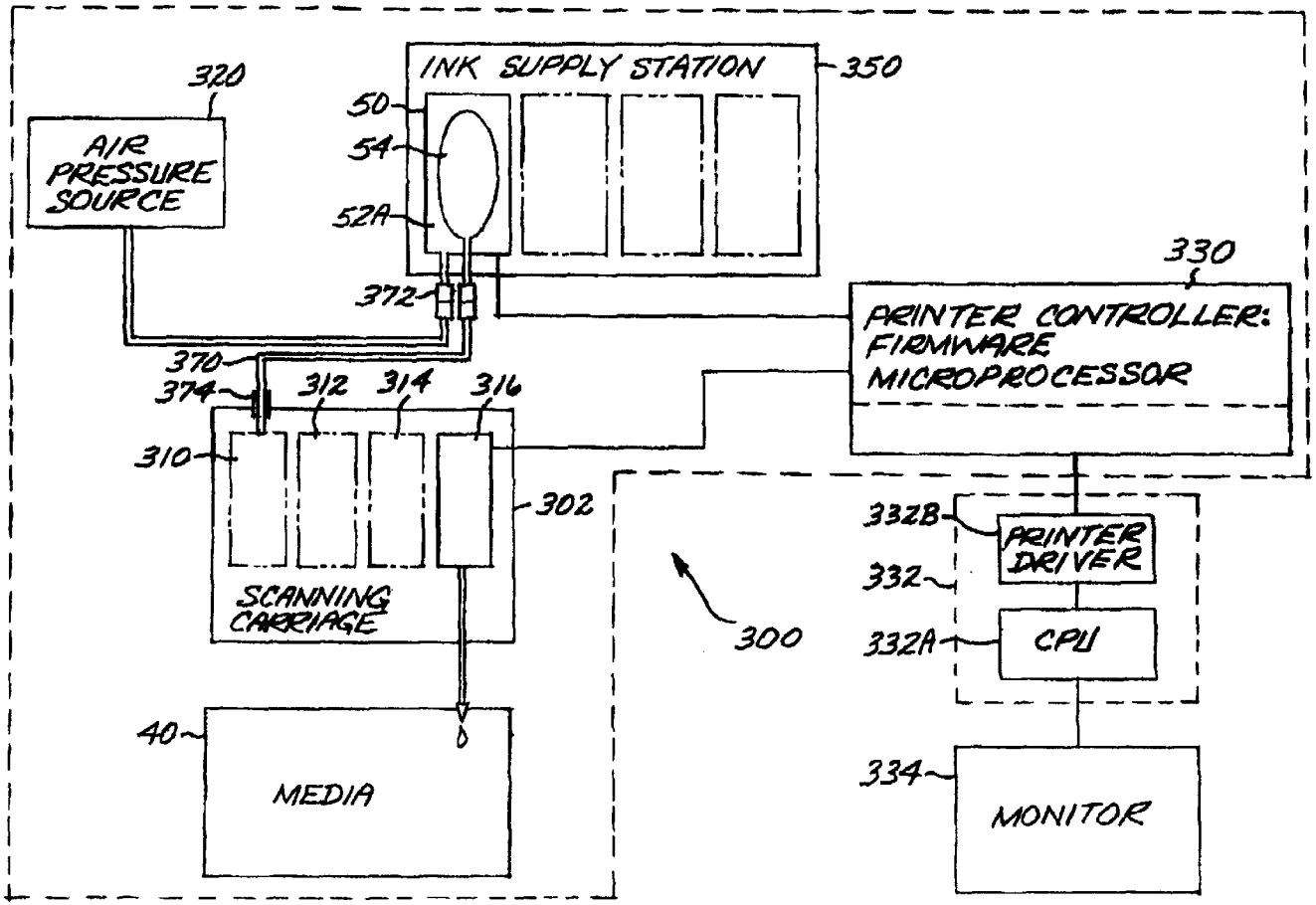
FIG. 14 is a schematic diagram of an ink jet printing system which can utilize the invention.

FIG. 14 shows an overall block diagram of a printer/plotter system 300 which embodies aspects of the invention. A scanning carriage 302 holds a plurality of high performance print cartridges 310–316 that are fluidically coupled to an ink supply station 400. The supply station provides pressurized ink to the ink jet print cartridges. Each cartridge has a regulator valve that opens and closes to maintain a slight negative gauge pressure in the cartridge that is optimal for printhead performance. The ink being received is pressurized to eliminate effects of dynamic pressure drops.

The ink supply station 350 contains receptacles or bays for slidable mounting a plurality of the ink containers 50. Each ink container has a collapsible ink reservoir 54 surrounded by an air pressure chamber 52A. An air pressure source or pump 320 is in communication with the air pressure chamber for pressurizing the collapsible reservoir. Pressurized ink is then delivered to the print cartridge, e.g. cartridge 310, by an ink flow path such as a tubing 370 and fluid interconnects 372 and 374 for respectively interconnecting ends of the tubing to the ink container 50 and the print cartridge 310. The tubing and fluid interconnects are preferably constructed to provide high barriers to air diffusion. The tubing can be constructed as described in U.S. Pat. No. 6,068,370 or U.S. Pat. No. 5,988,801. One air pump supplies pressurized air for all ink containers in this system. In an exemplary embodiment, the pump supplies a positive pressure of 2 psi, in order to meet ink flow rates on the order of 25 cc/min. Of course, for systems having lower ink flow rate requirement, a lower pressure will suffice, and some cases with low throughput rates will require no positive air pressure at all. For systems having higher ink flow rates, a higher pressure can be employed.

During idle periods, the region between the reservoir bag and the pressure vessel is allowed to de-pressurize. During shipping of the ink container 50, the supply is not pressurized.

The scanning carriage 302 and print cartridges 310–316 are controlled by the printer controller 330, which includes the printer firmware and microprocessor. The controller 330 thus controls the scanning carriage drive system and the print heads on the print cartridge to selectively energize the print heads, to cause ink droplets to be ejected in a controlled fashion onto the print medium 40.

The system 300 typically receives printing jobs and commands from a computer work station or personal computer 332, which includes a CPU 322A and a printer driver 322B for interfacing to the printing system 300. The work station further includes a monitor 334.

Figure 15:
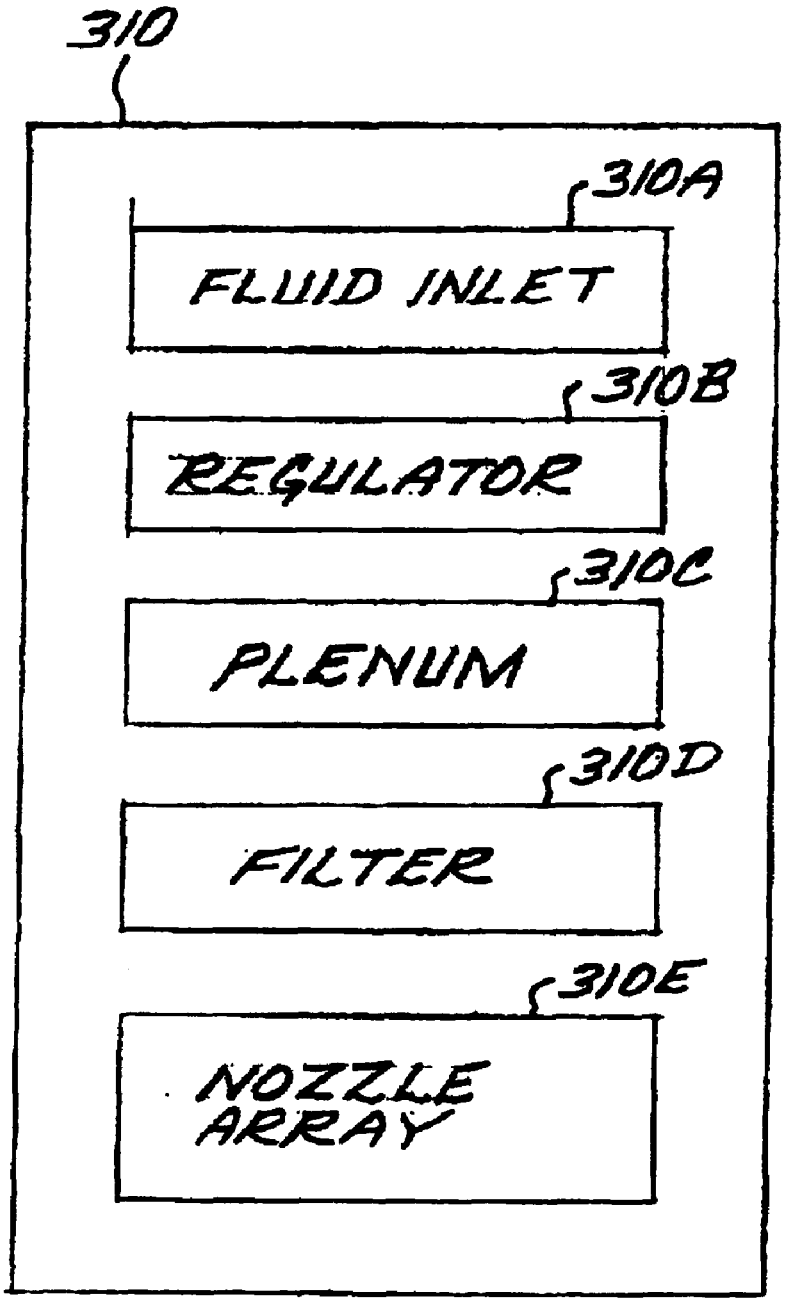
FIG. 15 is a schematic representation of an exemplary printhead used in the inkjet printing system of FIG. 14 in accordance with an aspect of the invention.

FIG. 15 is a schematic representation of an exemplary printhead 310 used in the inkjet printing system. The printhead 310 is a semipermanent printhead, since it can utilize the ink supplied from a plurality of the replaceable ink supplies 50. This allows the printhead to be of compact size, thus allowing reduction in the size of the printing system.

The printhead 310 includes a fluid interconnect 310A for connecting to a fluid conduit such as tubing 370 (FIG. 14), at an incoming pressure and then delivers the ink to nozzle array 310E at a controlled internal pressure that is lower than the incoming pressure. The nozzle array is fluidically coupled to a plenum 310C that stores a quantity of ink at the controlled internal pressure. Ink passes through a filter 310D before reaching the nozzle array to remove particulates and air bubbles. The negative pressure in the plenum 310C is controlled by a regulator 310B, which can include a valve and an actuator in an exemplary embodiment. As the nozzle array deposits ink on media, the ink in the plenum is depleted, decreasing the internal pressure in the plenum. When the internal pressure reaches a low pressure threshold, the regulator responds by allowing ink to pass from the fluid conduit into the plenum. This introduction of ink raises the pressure of the plenum. When the internal pressure reaches a high pressure threshold, the regulator closes the valve. Thus the regulator regulates the pressure in the plenum between the low pressure and the high pressure thresholds.

The printhead structure described in the above referenced application, Ser. No. 09/037,550, can be employed in the printhead 310. Alternatively, the printhead 310 can be a printhead of the type illustrated in pending application 09/748,059, filed Dec. 22, 2000, APPARATUS FOR PROVIDING INK TO AN INK JET PRINT HEAD, the entire contents of which are incorporated herein by this reference.

The plenum 310C has a warehouse capacity for storing a warehouse volume of air before the pressure regulation function of the regulator is rendered ineffective. Once the regulator fails, the pressure within the printhead rises, allowing ink drool from the nozzle array. Printheads can be employed with varying warehouse capacities, including for example 30 cc of air, 10 cc of air, 4.5 cc of air. These capacities allow regulator operation even while this amount of air has been introduced into the plenum. These warehouse capacities are a factor in the useful life of the semipermanent printhead 310. As a result of the measures described above with respect to the use of unsaturated ink and the air diffusion barriers in the ink supply 50 and the fluid conduit, the size of the printhead can be reduced, for a given nominal printhead life, to reduce the warehouse capacity of the printhead, thus allowing further miniaturization of the printhead. In one exemplary embodiment, the warehouse capacity of the plenum 310C is less than 4.5 cc of air.

It is understood that the above-described embodiments are merely illustrative of the possible specific embodiments which may represent principles of the present invention. Other arrangements may readily be devised in accordance with these principles by those skilled in the art without departing from the scope and spirit of the invention. For example, while the exemplary ink supply is a pressurized supply, the advantages of the invention are also applicable to non-pressurized ink supplies.

What is claimed is:

1. An ink supply for an inkjet printing system, the ink supply having one or more areas of relatively high air diffusion through one or more structures comprising the ink supply, the ink supply comprising one or more air diffusion barrier structures shielding each of said one or more areas of relatively high air diffusion from air diffusion, and a quantity of liquid unsaturated ink disposed in said ink supply, and wherein the ink supply includes a reservoir for holding the quantity of liquid unsaturated ink, a fluid interconnect for interconnecting to the printing system when the ink supply is installed in the printing system, wherein the one or more areas of relatively high air diffusion includes an ink flow path between the reservoir and the fluid interconnect, and wherein the one or more air diffusion barrier structures includes a first barrier structure for shielding the ink flow path from air diffusion from an external environment into the ink flow path, further comprising a chassis member fabricated of a material having a relatively high air diffusion rate, the chassis member having a fluid passage formed therethrough leading between a fluid interconnect port and an ink reservoir attachment, and wherein the first barrier structure shields the fluid passage.

2. The ink supply of claim 1 wherein the ink reservoir is a collapsible bag.

3. The ink supply of claim 2 wherein the collapsible bag is a multi-layered structure including a barrier layer providing a high barrier to air diffusion.

4. The ink supply of claim 3 wherein said barrier layer is a metalized layer or a high barrier polymer or a metal oxide deposition layer.

5. The ink supply of claim 1, wherein the liquid unsaturated ink has an air solubility level of 70% or less.

6. An ink supply for an inkjet printing system, the ink supply having one or more areas of relatively high air diffusion through one or more structures comprising the ink supply, the ink supply comprising one or more air diffusion barrier structures shielding each of said one or more areas of relatively high air diffusion from air diffusion, and a quantity of liquid unsaturated ink disposed in said ink supply, wherein the ink supply includes a reservoir for holding the quantity of liquid unsaturated ink, and a fluid interconnect for interconnecting to the printing system when the ink supply is installed in the printing system, the fluid interconnect including a septum for receiving a needle when the ink supply is installed in the printing system, wherein the one or more areas of relatively high air diffusion include the septum, and wherein the one or more barrier structures includes a septum barrier structure applied to the septum, wherein the septum barrier structure includes a metal layer affixed to the septum after the quantity of ink is disposed in said ink supply.

7. The ink supply of claim 6 wherein the metal layer is an adhesive-backed metal tape.

8. The ink supply of claim 6 wherein the metal layer is a layer of aluminum or copper.

9. An ink supply for an inkjet printing system, the ink supply having one or more areas of relatively high air diffusion through one or more structures comprising the ink supply, the ink supply comprising one or more air diffusion barrier structures shielding each of said one or more areas of relatively high air diffusion from air diffusion, and a quantity of liquid unsaturated ink disposed in said ink supply, and wherein the ink supply includes a reservoir for holding the quantity of liquid unsaturated ink, and a fluid interconnect for interconnecting to the printing system when the ink supply is installed in the printing system, the fluid interconnect including a septum for receiving a needle when the ink supply is installed in the printing system, and wherein the septum is fabricated of an elastomeric material having a high air diffusion barrier property, the septum comprising the one or more barrier structures, wherein the elastomeric material is selected from a group including EPDM, Butyl, an EPDM/polypropylene (PP) blend, or a Butyl/PP blend.

10. An ink supply for an inkjet printing system, the ink supply having one or more areas of relatively high air diffusion through one or more structures comprising the ink supply, the ink supply comprising one or more air diffusion barrier structures shielding each of said one or more areas of relatively high air diffusion from air diffusion, and a quantity of liquid unsaturated ink disposed in said ink supply, wherein the liquid unsaturated ink has an air solubility level of 70% or less, and wherein the air diffusion barrier structures are constructed to shield the liquid unsaturated ink from air diffusion so as to provide a shelf life of at least six months, such that the air solubility level does not exceed 70% during the shelf life.

11. The ink supply of claim 10, wherein said shelf life is at least eighteen months.

12. An ink supply for an inkjet printing system, the ink supply having one or more areas of relatively high air diffusion through one or more structures comprising the ink supply, the ink supply comprising one or more air diffusion barrier structures shielding each of said one or more areas of relatively high air diffusion from air diffusion, and a quantity of liquid unsaturated ink disposed in said ink supply, wherein the unsaturated ink has an initial saturation level of 20% or less, and wherein the air diffusion barrier structures are constructed to shield the liquid unsaturated ink from air diffusion so as to provide a shelf life of at least six months, such that the air solubility level does not exceed 70% during the shelf life.

13. A replaceable ink supply for an inkjet printing system including an inkjet printhead, the ink supply comprising:

an ink reservoir structure defining an ink reservoir;

a fluid interconnect fluidically coupled to the ink reservoir;

a body of unsaturated ink disposed in said ink reservoir;

the fluid interconnect providing a fluid path for the ink to pass from the reservoir to the printing system when the ink supply is installed in the printing system; and an air diffusion barrier system protecting the ink reservoir and the fluid interconnect from air diffusion for a shelf life of at least a period of six months, so that ink delivered to the printing system remains in an unsaturated condition for at least said period of six months.

14. The ink supply of claim 13, wherein the unsaturated ink in said reservoir has an air absorption capability after said period of six months, so that said unsaturated ink upon delivery to the inkjet printhead can absorb air within the printhead until an air saturation level in said ink is reached.

15. The ink supply of claim 13, wherein:

the ink reservoir structure includes a collapsible bag and a chassis structure to which the bag is attached;

the fluid interconnect comprises a fluid passageway formed by the chassis structure leading from the bag to a fluid outlet, and a septum disposed in said passageway at said fluid outlet; and the air diffusion barrier system includes a first barrier structure for shielding the passageway from air diffusion from an external environment into the fluid path, and a second barrier structure for shielding the fluid outlet from air diffusion into the fluid path from the external environment.

16. The ink supply of claim 15, wherein said collapsible bag is fabricated from a metallized layered structure.

17. The ink supply of claim 13, wherein the unsaturated ink has an initial saturation level of 20% or less at commencement of said shelf life, and wherein the air diffusion barrier structures are constructed to shield the liquid unsaturated ink from air diffusion such that the air solubility level does not exceed 70% during the shelf life.

18. The ink supply of claim 17 wherein said shelf life is at least eighteen months.

19. A replaceable ink supply for an inkjet printing system including an inkjet printhead, the ink supply comprising:

an ink reservoir structure defining an ink reservoir;

a fluid interconnect fluidically coupled to the ink reservoir;

a body of unsaturated ink disposed in said ink reservoir;

the fluid interconnect providing a fluid path for the ink to pass from the reservoir; and an air diffusion barrier system protecting the ink reservoir and the fluid interconnect from air diffusion; wherein the unsaturated ink in said reservoir has an air absorption capability after said period of six months, so that said unsaturated ink upon delivery to the inkjet printhead can absorb air within the printhead until an air saturation level in said ink is reached.

20. A replaceable ink supply for an inkjet printing system including an inkjet printhead, the ink supply comprising:

an ink reservoir structure defining an ink reservoir;

a fluid interconnect fluidically defining an ink reservoir;

a body of unsaturated ink disposed in said ink reservoir;

the fluid interconnect providing a fluid path for the ink to pass from the reservoir; and an air diffusion barrier system protecting the ink reservoir and the fluid interconnect from air diffusion, wherein the unsaturated ink has an initial saturation level of 20% or less at commencement of a shelf life, and wherein air diffusion barrier structures of the air diffusion barrier system are constructed to shield the liquid unsaturated ink from air diffusion such that the air solubility level does not exceed 70% during the shelf life.

21. The ink supply of claim 20 wherein said shelf life is at least eighteen months.

* * * * *

UNITED STATES PATENT AND TRADEMARK OFFICE

CERTIFICATE OF CORRECTION

PATENT NO. : 6,863,387 B2
APPLICATION NO. : 09/758744
DATED : March 8, 2005
INVENTOR(S) : Jeffrey L. Thielman et al.

It is certified that error appears in the above-identified patent and that said Letters Patent is hereby corrected as shown below:

IN THE SPECIFICATION

Column 5, line 50, before “included” insert --be--

IN THE CLAIMS

Claim 20, Column 12, line 35, delete “defining an” and insert therefor --coupled to the--

Signed and Sealed this

Twentieth Day of May, 2008

JON W. DUDAS
*Director of the United States Patent and Trademark Office*